United States Patent [19]

Sillery

[11] Patent Number: 5,068,968

[45] Date of Patent: Dec. 3, 1991

[54] ISOLATED PRESS FIT MUZZLE REFERENCE SIGHT MOUNT

[75] Inventor: Ruth C. Sillery, Albany, N.Y.

[73] Assignee: The United States of America as represented by the Secretary of the Army, Washington, D.C.

[21] Appl. No.: 637,035

[22] Filed: Jan. 3, 1991

[51] Int. Cl.[5] ..... F41G 1/30; F41G 1/38; F41G 1/54; F41G 11/00

[52] U.S. Cl. ..... 33/233; 33/235; 42/100

[58] Field of Search ..... 33/233, 234, 235, 245; 42/100, 101, 102, 103; 89/41.17, 41.19

[56] References Cited

U.S. PATENT DOCUMENTS

| | | | |
|---|---|---|---|
| 1,004,180 | 9/1911 | Mauser | 33/233 |
| 1,294,453 | 2/1919 | Hammond | 33/233 |
| 2,123,273 | 7/1938 | Burton | 33/233 |
| 2,306,176 | 12/1942 | Mathis | 33/42 |
| 2,380,965 | 8/1945 | Harvey | 33/233 |
| 2,645,017 | 7/1953 | Haase | 42/100 |
| 2,932,896 | 4/1960 | Hicinbothem | 42/100 |
| 4,232,449 | 11/1980 | Linenberger | 33/234 |
| 4,739,559 | 4/1988 | Hohensee et al. | 33/233 |
| 4,760,770 | 8/1988 | Bagnall-Wild et al. | 89/41.19 |
| 4,790,075 | 12/1988 | Howard, Sr. | 33/233 |

*Primary Examiner*—Thomas B. Will

*Attorney, Agent, or Firm*—Anthony T. Lane; Edward Goldberg; Michael C. Sachs

[57] ABSTRACT

An improved reference sight mount device for use with a gun. The reference sight mount attaches to a gun tube having a mount receiving zone near the tube muzzle end. The mount includes a bracket for mounting a reference sight, and includes a band having a conformed internal diameter conforming to the receiving zone. The mount has an integral sight mounting bracket thereon and a lock for engagement with the gun tube. Three embodiments are described. In one embodiment, the mount receiving zone includes a shrink fit zone and the mount includes a conformed zone formed by a band having an internal diameter sized to expand upon heating and shrink into conformity with the mount receiving zone. In the preferred embodiment, the mount receiving zone includes a tapered press fit zone near the tube muzzle end and the band includes a tapered internal diameter press fit zone. The third, in addition to the features of the above preferred embodiment includes an integral, tailored, flexible isolation member between the band and optical reference sight housing.

2 Claims, 1 Drawing Sheet

ISOLATED PRESS FIT MUZZLE REFERENCE SIGHT MOUNT

The invention described herein may be made, used, or licensed by or for the Government for Governmental purposes without the payment to me of any royalties thereon or therefore.

FIELD OF THE INVENTION

The present invention relates to a reference sight mount device for use with large caliber guns. More particularly, the invention relates to a gun tube having a short tapered zone on the outside diameter near the muzzle end. This section has a stop shoulder on its breech side and a threaded section on the muzzle side. This zone accepts the muzzle reference mount which has mating internal zones and is pressed on the gun tube and secured by a threaded locking ring.

BACKGROUND OF THE INVENTION

Large caliber guns have been found to be subjected to thermally induced deflections, particularly during repeated fire, and these deflections change the muzzle pointing angle. This in turn significantly affects the projectile impact location.

Efforts have been made to minimize impact errors. In order to do this, a muzzle reference sight has been proposed to be attached to the gun muzzle. This muzzle reference sight is intended to provide information to the gunner by quantifying changes in muzzle pointing angle. This information is provided as input into an existing fire control computer or may be used directly by the gunner to correct the aim point and/or realign the gun sights with the new muzzle pointing angle.

Most muzzle reference sights are either optical devices that emit a reference beam of light, or they are devices using mirrors which reflect a reference beam of light. This provides a response to changes which are thermally induced into the gun muzzle, so that initially parallel sighting between the gunners sight and the muzzle reference sight is corrected by adjustment of the gunners sight to conform to changes detected by the muzzle reference sight.

It has been discovered that the mounting technique which is used to secure the muzzle reference sight to the gun tube is a critical link. The prior art has failed to appreciate that if the muzzle reference sight mount moves with respect to the muzzle, the entire system can be degraded or may even produce errors greater than the system has been designed to correct.

Prior art methods of mounting a muzzle reference sight system may be classified into two basic groups. Prior art systems involve either a strap on device or a bolt on device. Strap on devices are typically composed of steel bands which are tightened on the gun tube with bolts. Because the tension is applied at one location, the straps must be flexible enough to equally distribute the tension and yet must also be strong enough to resist deformation during firing.

No such combination has been achieved for guns such as 120 mm high energy canons. Prior art designs which minimally function for 105 mm canons have failed when tested on the next generation models, such as 120 mm canons. Even with significant effort being made to strengthen the prior art strap device, no satisfactory design has been achieved.

Bolt on designs which include flat platforms have been proposed as well. These designs also have inherent problems which limit their effectiveness. As pressure in the gun tube causes the tube to dilate, either the platform must warp or the tube must deform asymmetrically. Warping of the platform can and often does break the mounting bolts or warp the muzzle reference sight. ,Asymmetric deformation of the gun tube will degrade accuracy and decrease tube life. Both problems are not possible to be avoided.

The problem with muzzle reference sights is seen as getting more severe as current developments produce much higher muzzle forces Even on current experimental guns and even using current ammunition, the prior art systems have failed. Extremely high forces have broken the muzzle reference sight systems. Development of more powerful ammunition will achieve improved performance, but will produce even greater muzzle forces, thus making prior art muzzle reference sight systems even less effective. Application of future ammunition to improved guns will degrade present systems, possibly to a point of uselessness Accordingly, it is an object of the present invention to develop an improved muzzle reference sight system. More particularly, it is an object of this invention to develop a muzzle reference sight which avoids slippage, and which is somehow isolated from severe muzzle loads. Other objects will appear hereinafter.

SUMMARY OF THE INVENTION

It has now been discovered that the above and other objects of the present invention may be accomplished in the following manner. Specifically, a reference sight mount device for use with a gun has been discovered. The device mates with a large caliber gun tube having a precision pilot receiving zone near said tube muzzle end. Also included is a threaded zone near said tube muzzle end. The reference sight mount includes a band having an internal diameter that conforms to the receiving zone on the gun tube. The mount has an integral sight mounting bracket thereon and a lock means for engagement with the threads on the gun tube.

In one embodiment, the mount/tube receiving zone includes two external pilot zones with a threaded zone in the middle. The reference sight band includes mating internal threaded and shrink fit zones. The shrink fit zones are expanded by heating so the mount can be threaded on the gun tube. An index pin is provided that protrudes from the outside diameter of the mount band through a pilot hole and into a pilot slot in the muzzle of the gun tube. This pin assures proper orientation of the sight mount. As the mount cools the shrink fit zones contract into conformity with said receiving zone.

In another, preferred embodiment, the mount receiving zone includes a tapered press fit zone with a stop shoulder on the breech end side where the taper is at its largest diameter, and a threaded zone on the muzzle side where the taper is at its smallest diameter. The sight mount band has a mating internal tapered zone of smaller diameter. The mount, therefore must be pressed on the gun tube until it contacts the stop shoulder forcing the tapers into conformity. The mount band also includes an integral key that engages a slot in the gun tube. This determines proper orientation. A threaded nut is provided to maintain a muzzle end stop surface.

In an additional preferred embodiment, the sight mounting bracket includes a flexible isolation member between said mount band and the reference sight. The flexible isolation bracket means includes a tailored leaf spring for isolating said reference sight from the severe gun firing forces.

BRIEF DESCRIPTION OF THE DRAWINGS

For a more complete understanding of the invention, reference is hereby made to the drawings, where like numbers refer to like elements, in which.

DETAILED DESCRIPTION OF THE INVENTION

Figure 1:
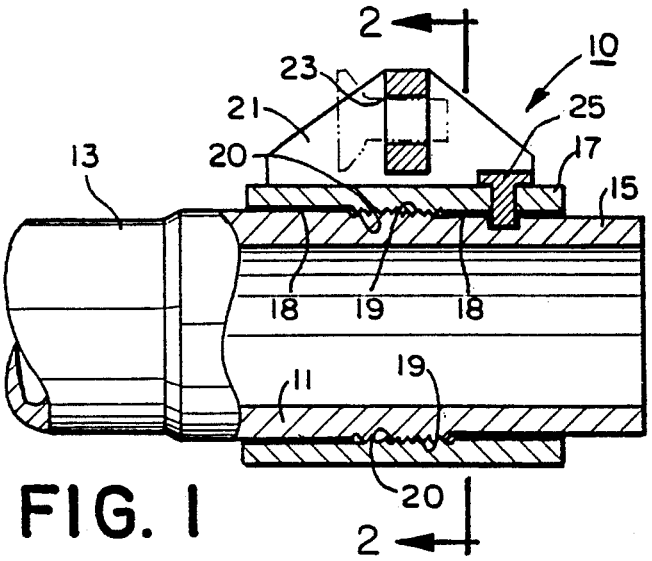
FIG. 1 is a side elevational, sectional view of one embodiment of the present invention.

As shown in FIG. 1, the device, 10 generally, is attached to a gun tube 11 which has a breech end 13 and a muzzle end 15. Attached to the gun tube 11 is a mount means 17 which, in this embodiment, is a shrink fit mount. Mount 17 is in the form of a band 17 which has been machined with two internal diameter shrink zones 18 which are separated by threaded zone 19 on the gun tube 11 and threaded zone 20 on mount 17.

Figure 2:
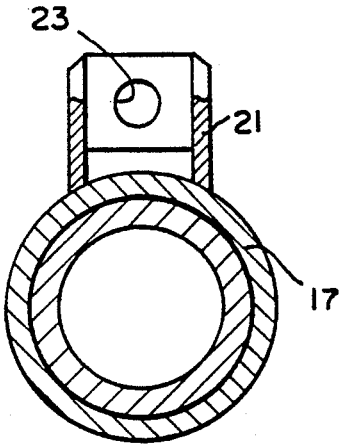
FIG. 2 is a view taken along line 2—2 of FIG. 1.

A muzzle reference mounting bracket 21 is welded to the outside diameter of band 17, for use with a sight 23 or the like. A hole for an index pin 25 is machined through the muzzle end of band. The shrink mount band 17 is then heated and screwed onto tube 11, as shown in FIG. 1 and FIG. 2. The shrink fit zones 18 grip the tube 11 as the band 17 is cooled.

The band 17 is held tight to tube 11, and the grip will increase as the tube 11 is pressurized during firing. Threading 19 and 20 cooperate to maintain high stability and prevent axial motion of the mount 17 with respect to the tube 11. Locating pin 25 fixes mounting orientation and also prevents rotation.

Advantages of the design shown in FIG. 1 are that there is increased gripping force as gun pressure increases. There is a symmetric low profile muzzle configuration and stress is evenly distributed at the gun muzzle. There is a large degree of orientation flexibility, as the location pin 25 can be reoriented to accommodate different muzzle reference sighting systems.

The design of FIG. 1 and FIG. 2 was tested using a reflecting muzzle reference sight with complete success. There do not appear to be any near term development guns or ammunition which would be too powerful for this device. In fact, the only drawback to the design of FIG. 1 is that it is somewhat difficult to remove the mount due to the high temperature needed to reverse the shrink fit.

Figure 3:
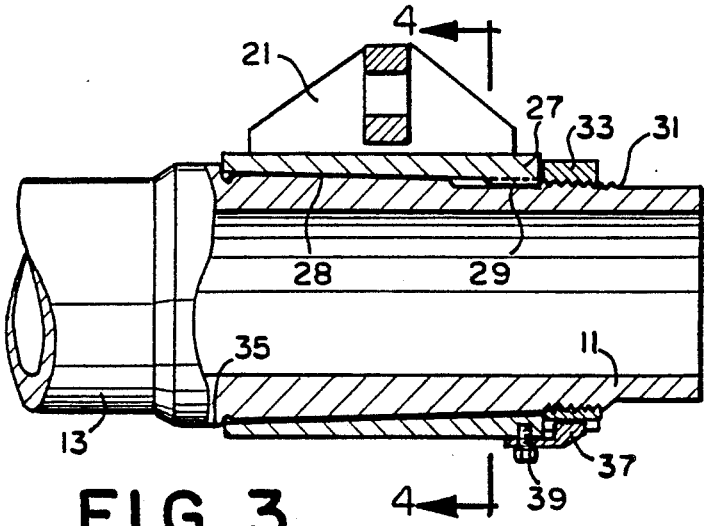
FIG. 3 is a side elevational, sectional view of another embodiment of the present invention.
Figure 4:
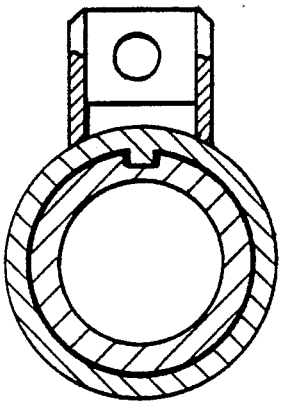
FIG. 4 is a view taken along line 4—4 of FIG. 3.

Shown in FIG. 3 and FIG. 4 is the preferred mount means of the present invention. Gun tube 11 is provided with a press fit mount 27, which is a band having a tapered internal diameter which matches a tapered pilot diameter on gun tube 11 to define a press fit zone 28, which is bounded by a shoulder on the breech end 13 and threads on the muzzle end. Band 27 again holds a muzzle reference sight bracket 21 which can be fitted with any of the conventional sights.

In this embodiment, the index key 29 is integral with the band 27, and the threaded connection is provided by threads 31 and retaining nut 33. The press mount band 27 is pushed on the gun tube 11, using a conventional press tool, not shown, until the band 27 contacts shoulder 35 on tube 11. Retaining nut 33 is then screwed on the tube 11 threads 31 up against the muzzle face end of mounting band 27. A lock 37 is then secured using screws 39.

This embodiment has all the features and advantages of the shrink fit mount and also offers easy installation and disassembly with a single simple mechanical tool.

To attenuate the most severe muzzle forces possible, another embodiment has been provided to prevent damage to the particular muzzle reference sight units being used. In addition to shifting the mount on prior art devices, these severe muzzle forces break the sight devices themselves.

Figure 5:
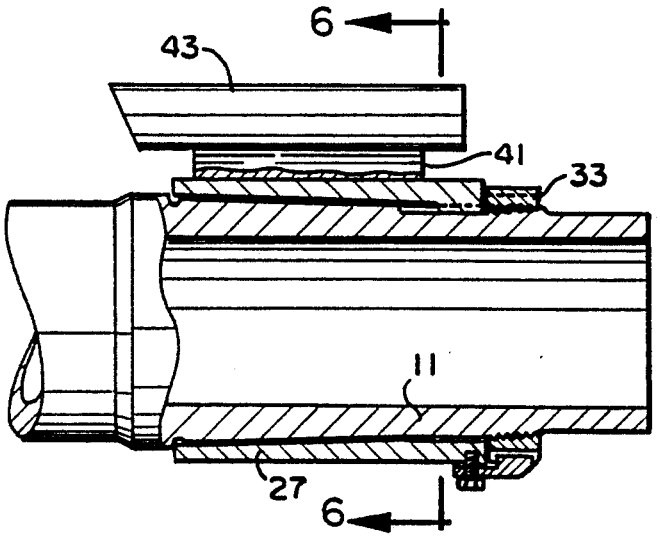
FIG. 5 is a view similar to that in FIG. 3, with an additional preferred embodiment shown.
Figure 6:
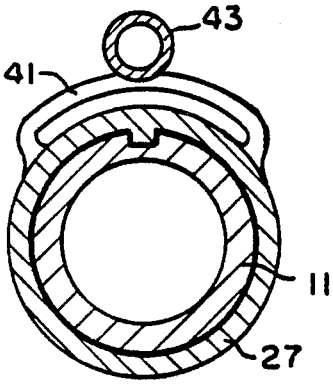
FIG. 6 is a view taken along line 6—6 of FIG. 5.

Shown in FIG.5 and FIG.6 is a preferred embodiment, where the mount bracket has a flexible isolation bridge 41, consisting essentially of a specially tailored leaf spring 41 which connects the mount band 27 to the optical muzzle reference sight housing 43. Bracket 41 significantly reduces the forces transmitted from the gun tube 11 to the sight housing 43. It is specifically designed so that both vehicle driving frequency and the cannon firing frequency do not resonate the unit.

While various modifications and variations will become apparent from a reading of the present description, the invention for which exclusive rights are claimed is defined in the following claims.

What is claimed is:

1. A reference sight mount device for use with a large caliber gun comprising:

a gun tube having a tube muzzle end and a mount receiving zone near said tube muzzle end; and a mount means for mounting a reference sight, including a band having an internal diameter conforming to said mount receiving zone, said mount means having an integral sight mounting bracket thereon, and a lock means for rigidly fixing the position of said mount means at the muzzle end of said gun tube, wherein said mount receiving zone includes a shrink fit zone, and wherein said mount means includes a conformed zone formed by a band having an internal diameter sized to expand upon heating and shrink into conformity with said shrink fit zone on said gun tube, and wherein said band also includes shrink fit zones at both ends of said band and an internal threading positioned inbetween said shrink fit zones of said hand, said mount receiving zone further having a conforming threading for cooperation with said internal threading.

2. A reference sight mount device for use with a gun, comprising:

a gun tube having a defined muzzle end and a mount receiving zone having a threaded end thereof, and also including a shrink fit zone thereon near said tube muzzle end; and a mount means for mounting a reference sight, including a conformed zone formed by a band having an internal diameter sized to expand upon heating and shrink into conformity with said mount receiving zone, said mount means also including a sight mounting bracket thereon and lock means to prevent rotation of said mount means relative to said gun tube, and wherein said band further includes shrink fit zones at both ends of said band and an internal threading positioned inbetween said shrink fit means of said band, said mount receiving zone further having a conforming threading for cooperation with said internal threading.

* * * * *